US005205722A

United States Patent [19]

Hammond

[11] Patent Number: 5,205,722

[45] Date of Patent: Apr. 27, 1993

[54] METERING PUMP

[76] Inventor: John M. Hammond, 6172 Knickerbocker Rd., Ontario, N.Y. 14519

[21] Appl. No.: 710,323

[22] Filed: Jun. 4, 1991

[51] Int. Cl.[5] ..... F04B 43/06

[52] U.S. Cl. ..... 417/395; 417/347; 417/383

[58] Field of Search ..... 417/395, 383, 347

[56] References Cited

U.S. PATENT DOCUMENTS

| | | | |
|---|---|---|---|
| 2,592,940 | 4/1952 | Monoyer | 417/347 |
| 2,673,525 | 3/1954 | Lucas | 417/395 |
| 3,213,804 | 10/1965 | Sobey | 417/395 |
| 3,232,524 | 2/1966 | Rice | 417/395 |
| 3,937,400 | 2/1976 | Krause | 239/3 |
| 4,068,641 | 1/1978 | Johnson | 417/395 |
| 4,269,569 | 5/1981 | Hoover | 417/347 |
| 4,583,920 | 4/1986 | Linoner | 417/395 |
| 4,844,706 | 7/1989 | Katsuyama | 417/395 |
| 4,946,100 | 8/1990 | Flemming | 239/1 |

*Primary Examiner*—Richard A. Bertsch
*Assistant Examiner*—Peter Korytnyk
*Attorney, Agent, or Firm*—Howard J. Greenwald

[57] ABSTRACT

An apparatus for continuously pumping fluid at a substantially constant flow rate is disclosed. This apparatus is comprised of a metering pump, a rotary timing valve, at least three fluid transducers, and means for synchronizing said metering pump with said rotary timing valve.

10 Claims, 10 Drawing Sheets

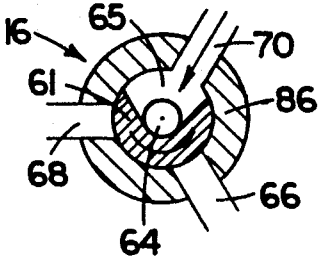
FIG. 12B
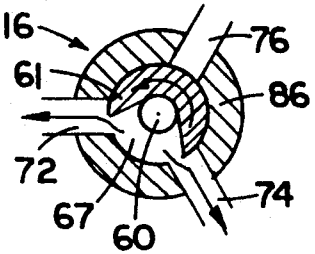
FIG. 12A
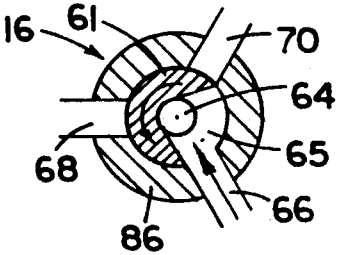
FIG. 9B
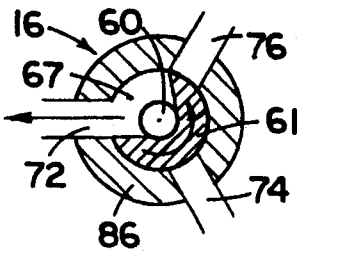
FIG. 9A
FIG. 13B
FIG. 13A
FIG. 10B
FIG. 10A
FIG. 14B
FIG. 14A
FIG. 11B
FIG. 11A 16
60
61
64
65
66
67
68
70
72
74
76
86

METERING PUMP

FIELD OF THE INVENTION

A metering pump containing a rotary timing valve is disclosed. This metering pump assembly may be used to continuously provide fluid flow at a substantially constant flow rate.

BACKGROUND OF THE INVENTION

Pumping devices for supplying material to various types of machines are well known to those skilled in the art. However, to the best of applicant's knowledge, no such device is available which provides fluid at a substantially constant flow rate, provides reliable, long-term operation when used with abrasive or corrosive or viscous fluids, and minimizes the risk of leakage, ignition, or explosion of the pumped fluid or its vapors.

One prior art device was described in July of 1989, in U.S. Pat. No. 4,844,706 of Kazuo Katsuyama et al. In discussing the problems with the use of prior art rotary pumps in systems where a constant flow rate was desired, Katsuyama disclosed (at column 1) that ". . .even if the rotary pump is driven at constant number of rotation, the flow rate of the coating material may vary due to the change in the pressure loss at the suction port- or discharge port of the rotary pump depending upon the flowing state of the coating material. . .and there has been a problem, e.g., in a two-component coating material that the main agent and the curing agent therefor can not be supplied at an accurate mixing ratio."

According to Katsuyama et al., in addition to the uneven flow rate often caused by the use of a rotary pump, the use of such pump with viscous or abrasive fluids often caused a problem. Thus, at column 2 of the patent, he stated that the ". . .use of a gear pump may be considered for supplying a highly viscous paint under pressure. However, there has been a problem that the viscous coating material adheres and clogs at the bearing portion of the gear pump during long time operation to often interrupt the rotation of the pump. In addition, in the case of using a highly viscous paint, particularly a metallic paint, the metal ingredient is ground by the gear pump failing to obtain uniform coating quality."

The pumping system described in the Katsuyama et al. patent to these problems was complicated and expensive and contained at least two double-acting reciprocal pumping means, two rotary pumps, a plurality of on-off valves, timer means, a pressure control valve, and other mechanisms. However, it does not appear that the device of the Katsuyama et al. patent adequately solves either of the problems it discusses.

In the first place, it does not appear that the device of the Katsuyama et al. patent provides a substantially constant flow rate for the fluid being delivered over its entire cycle. As is disclosed at column 10 of the Katsuyama et al. patent, and illustrated in FIG. 2, the device of this patent contains two "hydraulically powered reciprocal pumps 3A and 3B;" fluid is delivered from one of such pumps until the material in such pump is substantially depleted (see from points T4 to T6 on FIG. 2), then the second of such pumps is turned on (see point T5 on FIG. 2) and fluid is delivered from it while fluid continues to be delivered from the first pump, and thereafter the first pump is turned off (see point T6 of FIG. 2) and then refilled with fluid (see from points T7 to T8 of FIG. 2); after the fluid in the second pump is substantially depleted, the cycle is repeated. At the point in the cycle where one of the pumps is turned off (see, e.g., points T6 or T10 of FIG. 2), the hydraulic fluid being furnished to side 10 of the other pump (see FIG. 1) and the coating fluid being discharged from side 9 of the other pump must accelerate sharply in their respective fluid lines, thereby substantially changing the flow rate of such fluids.

In the second place, it does not appear that the device of the Katsuyama et al. patent provides reliable, long-term operation when used with abrasive or viscous fluids; for the pumping device disclosed in the Katsuyama et al. patent contacts the fluid to be delivered with the working parts of at least one rotary pump ( see column 5 of the patent).

Furthermore, as indicated below in the discussion of the Prus et al. patent, the fact that the Katsuyama et al. device contacts the fluid to be delivered with the working parts of at least one rotary pump often changes the rheological properties of such fluid and/or creates an explosion or pollution hazard.

The Prus et al. patent also recognized certain problems with prior art pumping systems Prus et al. disclosed a coating product installation. The Prus et al. patent stated that, when prior art gear pumps were used for the delivery of paint or varnish, they were ". . .unreliable, requiring frequent adjustment of the pump flowrate. . . .the component parts of the gear pump used under such conditions wear more rapidly . . .and. . .this wear results in internal leakage. . . . In fact, such leakage exists even when the pump is brand new. . .(see from line 67 of column 1 to line 10 of column 2)." The solution provided by Prus et al. was to connect the gear pump used in his system to a means for delivering rinsing product and to periodically flush his pump. However, in addition to causing his pump to be out of the production cycle for substantial periods of time, the use of "rinsing product" with different rheological and chemical properties tended to damage the gears in the pump and the flow rate sensors used in the system Prus et al. recognized that ". . .abrupt changes in operating conditions resulting from the succession of products of different kinds and of very different viscosities in the conduit. . ." may cause ". . .wear of and damage to the flowrate sensor" (see Column 4, lines 19–29).

However, the pumping device disclosed in the Prus et al. patent contacts the fluid to be delivered with the working parts of at least one rotary pump (see, for example, column 3). It is well known that such contact is often undesirable. Thus, for example, the turbulence and mixing caused by rotary pumps may often change the rheological properties of shear-sensitive materials, such as latex (see, e.g., page 3.55 of Igor J. Karassik et al.'s Pump Handbook, Second Edition, McGraw-Hill Book Company, New York, 1984). Thus, for example, some fluids and/or their vapors (such as organic peroxides) tend to explode when subjected to shock and/or vibration and thus should not be contacted with the moving parts or seals of a rotary pump. Thus, for example, some fluids may leak from the rotary pumps that they are in contact with, thereby creating pollution and/or explosion hazards.

There are other problems with the prior art pumping systems which are not mentioned by the Katsuyama et al. and the Prus et al. patents. Thus, for example, the pumping device of the Katsuyama et al. patent is comprised of several electrical control devices which appear to be capable of generating electrical discharges. It is known that certain pumpable fluids, such as hydrocarbon solvents, are readily ignited when subjected electrical spark discharges, which are often present in electrical motors, solenoid valves, and actuators. Thus, the device of the Katsuyama et al. patent might present a fire and/or explosion hazard when used with these ignitable and/or explosive fluids.

The systems described in the Katsuyama et al. and the Prus et al. patents utilize rotary pumps, with all of the disadvantages attendant thereto. However, other pumps also present problems when an attempt is made to use them for an application requiring a constant flow rate.

Thus, by way of illustration, U.S. Pat. No. 3,937,400 of Krause describes an apparatus for spraying paint. Krause discloses that, in such an apparatus, "The use of conventional diaphragm pumps is unsatisfactory because of the pulsating nature of the feed (see lines 27-29 of column 1)." A similar teaching is presented at pages 7-24 of James P. Poynton's "Metering Pumps" (Marcel Dekker, Inc., New York, 1983).

It is an object of this invention to provide a pumping apparatus which can continuously deliver fluid without contacting such fluid with the internal part or seals of a rotary pump.

It is another object of this invention to provide a pumping apparatus which can continuously deliver fluid without passing such fluid in contact with or near any devices which could generate electrical discharges.

It is an object of this invention to provide a pumping apparatus which can continuously deliver viscous and/or abrasive and/or corrosive material at a substantially constant flow rate without the need for periodic rinsing.

It is another object of this invention to provide a pumping apparatus which, during its entire cycle, does not accelerate the fluid being pumped to any substantial degree.

It is another object of this invention to provide a pumping apparatus which does not subject the fluid being pumped to any substantial amount of shear.

It is an object of this invention to provide a pumping apparatus which can continuously delivery viscous and/or abrasive and/or corrosive material at a substantially constant flow rate which is substantially more reliable than prior art pumping devices.

It is yet another object of this invention to provide a pumping apparatus for delivering abrasive and/or corrosive material which contains at least one flowrate meter, wherein the flowrate meter is exposed to neither said abrasive and/or corrosive material nor to any abrupt changes in operating conditions.

It is another object of this invention to provide a pumping apparatus which is relatively uncomplicated and inexpensive.

It is yet another object of this invention to provide a novel rotary timing valve.

It is yet another object of this invention to provide a novel fluid transducer.

It is yet another object of this invention to provide a novel pumping apparatus comprised of a rotary pump which is capable of delivering fluid without contacting said fluid with any of the parts of the rotary pump.

SUMMARY OF THE INVENTION

In accordance with this invention, there is provided an apparatus for continuously pumping fluid at a substantially constant flow rate. This apparatus is comprised of a metering pump, a rotary timing valve, at least three fluid transducers, and means for synchronizing said metering pump with said rotary timing valve.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIGS. 9A through 20A are sectional views of the rotary timing valve of FIG. 7, showing its port arrangements at various points through a full cycle of angular displacement;

FIGS. 9B through 20B are sectional views of the rotary timing valve of FIG. 8, showing its port arrangements at various points through a full cycle of angular displacement;

DESCRIPTION OF THE PREFERRED EMBODIMENTS

Figure 1:
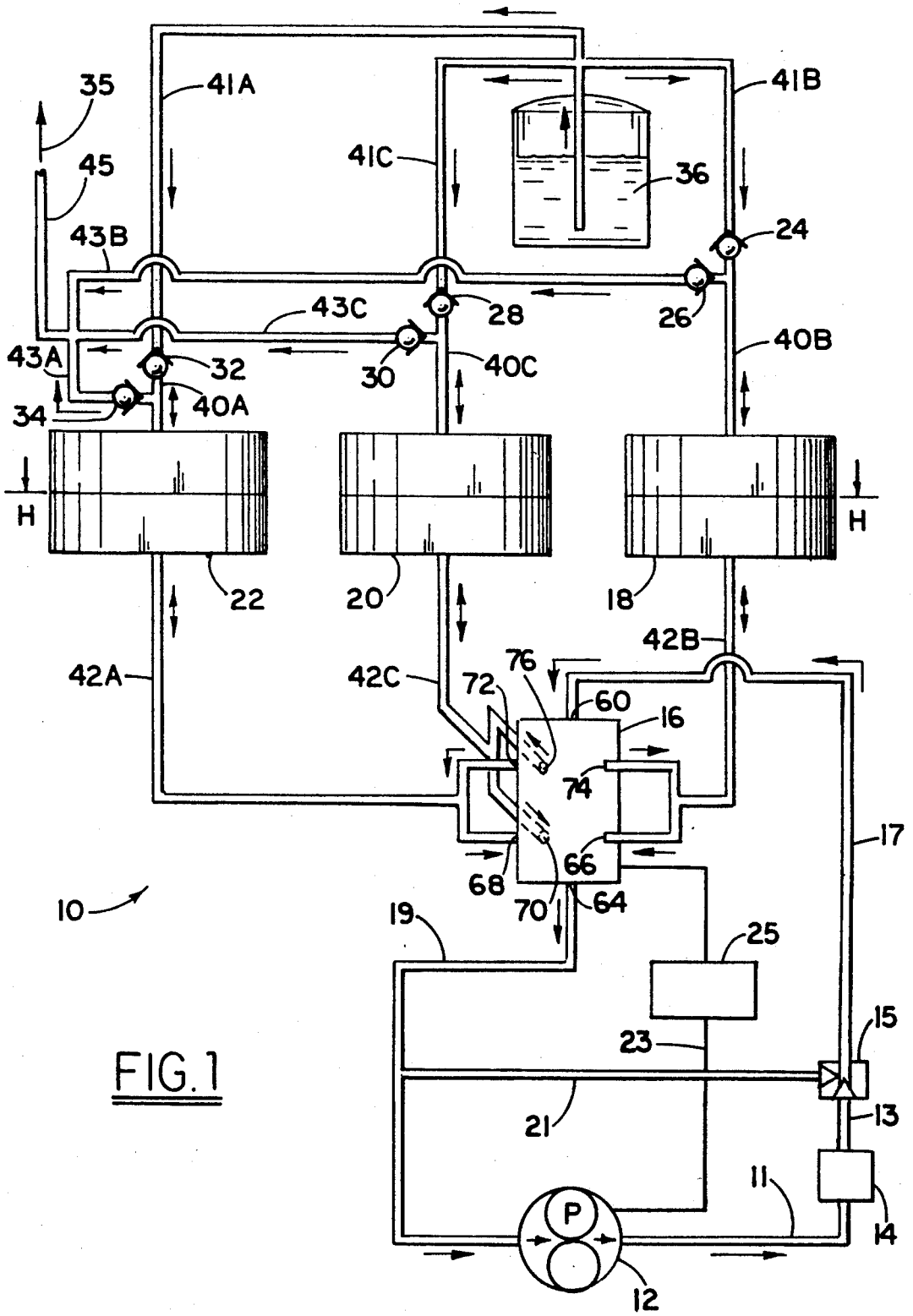
FIG. 1 is a schematic diagram of one preferred embodiment of applicant's system.

FIG. 1 is a schematic of one preferred embodiment of applicant's invention. Referring to FIG. 1, it will be seen that applicant's metering pump 10 is preferably comprised of a rotary gear pump 12, flow meter 14, rotary timing valve 16, fluid transducers 18, 20, and 22, valving means 24, 26, 28, 30, 32, and 34, and process fluid reservoir 36.

Referring to FIG. 1, gear pump 12 circulates hydraulic fluid into rotary timing valve 16 which, in turn, directs this fluid into one or two of fluid transducers 18, 20, and 22, thereby forcing process fluid in said transducer(s) out through one or more of such valving means to a desired location, indicated by arrow 35. At the same time, gear pump 12 is drawing hydraulic fluid through porting in the rotary timing valve 16 from one or two of the fluid transducers 18, 20, and 22, thereby causing process fluid from reservoir 36 to flow into one or more of such fluid transducers.

Figure 2:
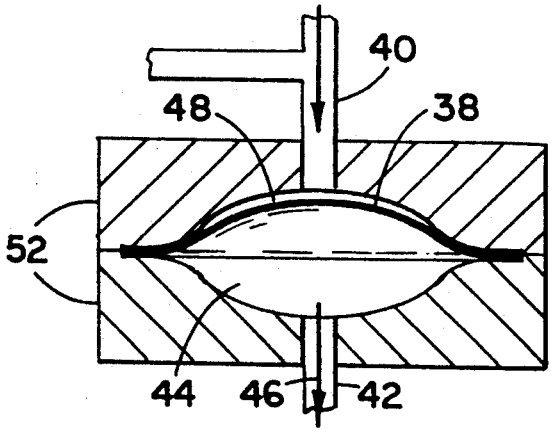
FIGS. 2, 3A, 3B, 4, and 5 are sectional views of a preferred fluid transducer used in the embodiment of FIG. 1, showing said transducer at different stages of a pumping cycle.

FIG. 2 is a sectional view of a preferred embodiment of fluid transducer 18. Fluid transducers 20 and 22 preferably have a similar configuration.

Referring to FIG. 2, it will be seen that fluid transducer 18 provides a means for coupling one fluid to another without either fluid contacting the other.

Any of the fluid transducers known to those skilled in the art may be used as fluid transducer 18 and/or 20 and/or 22. Thus, by way of illustration and not limitation, one may use fluid transducer 3A or 3B of Katsuyama et al.'s U.S. Pat. No. 4,844,706, the disclosure of which is hereby incorporated by reference into this specification. Thus, by way of further illustration, one also may use the fluid transducer described in U.S. Pat. No. 3,937,400 of Krause, the disclosure of which is also hereby incorporated by reference into this specification. The Krause transducer comprises a diaphragm assembly comprising a casing, a flexible impermeable diaphragm sealed across the casing to define a pumping chamber and a pressurizing chamber separated from one another by the diaphragm, porting to the pressurizing chamber for the introduction and discharge of a pressurized fluid porting to the pumping chamber for the introduction and discharge of paint, and means for supplying a predetermined volume of pressurized fluid to the pressurizing chamber, whereby said diaphragm is flexed so as to discharge an equivalent volume of paint from the pumping chamber.

By way of further illustration, fluid transducers are also described on pages 12–18 of James P. Poynton's "Metering Pumps," supra. Thus, one may use the disc diaphragm liquid end, the single tubular diaphragm liquid end, the double tubular diaphragm liquid end, the disc/tubular diaphragm liquid end, and the double disc diaphragm liquid end fluid transducers described therein.

By way of further illustration, the fluid transducer may comprise a piston and cylinders; such a device is described in the aforementioned Krause patent and in U.K. patent Application No. 5237/63, the disclosure of which is hereby incorporated by reference into this specification. Such a device is also described in U.S. Pat. No. 4,946,100 of Fleming et al. (see column 4), the disclosure of which is also hereby incorporated by reference into this specification.

Referring again to FIG. 2, it will be seen that each of fluid transducers 18, 20, and 22 is comprised of a diaphragm 38. This diaphragm 38 separates fluid in line 40 from fluid in line 42.

Figure 3A:
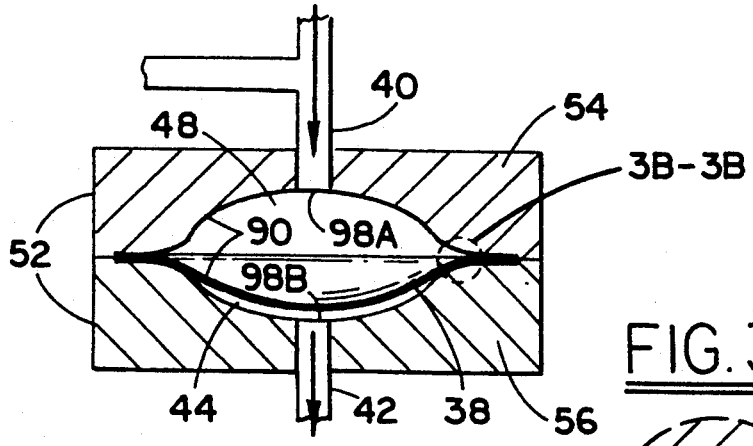
Figure 3B:
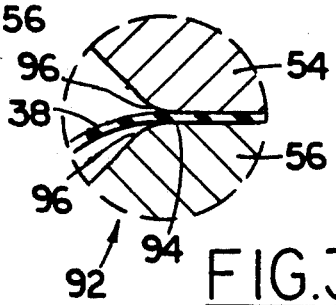

When fluid is withdrawn from cavity 44 via line 42, the diaphragm 38 is displaced downwardly in the direction of arrow 46, thereby drawing fluid from reservoir 36 (not shown in FIG. 2) into cavity 48 via line 40. As illustrated in FIG. 3, when diaphragm 38 has been displaced downwardly to substantially its maximum extent, the volume of fluid in cavity 48 substantially exceeds the volume of fluid in cavity 44. In general, in the preferred embodiment illustrated in FIG. 1, the ratio of the volume of fluid in cavity 48 to the volume of fluid in cavity 44 will range from about 1:10 to about 10:1 over the entire pumping cycle.

Figure 4:
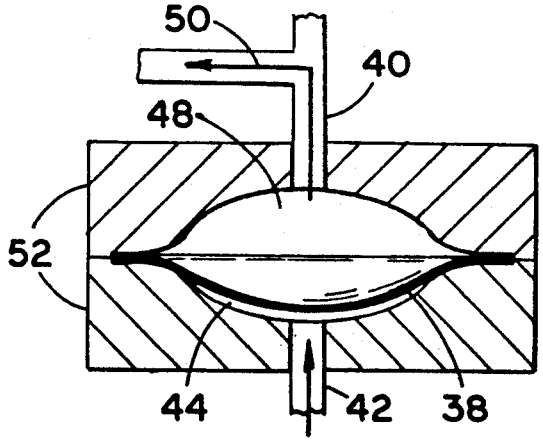
Figure 5:
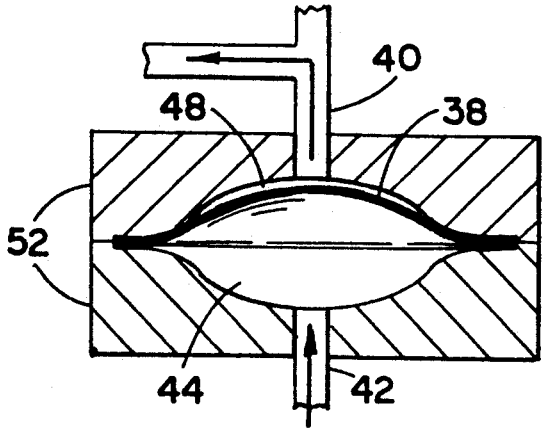

Referring to FIG. 4, when one wishes to reverse the cycle, fluid may be expelled from cavity 48 in the direction of arrow 50; one may expel such fluid by introducing hydraulic fluid at a higher fluid pressure via line 42 into cavity 44. As shown in FIG. 5, this will cause diaphragm 38 to return to substantially the same position as is shown in FIG. 2.

The fluid transducer 18 preferably is comprised of a casing 52. Any material conventionally used as pump casings may be used as casing 52. It is preferred that casing 52 be resistant to physical and/or chemical degradation when exposed to the material being pumped, and that it also be easy to fabricate. Thus, by way of illustration, one may use stainless steel, "MONEL" (a corrosion-resistant alloy comprised primarily of nickel and copper with a very small percentage of carbon, manganese, iron, sulfur, and silicon, which is sold by Huntington Alloys of Huntington, W.V.), "HASTELLOY" (a high-strength, nickel-based, corrosion-resistant alloy sold by the Cabot Corporation of Kokomo, Indiana), "TEFLON" (a fluorinated polymer sold by the E. I. du Pont de Nemours and Company of Wilmington, Del.), and the like.

The casing 52 may be an integral assembly, comprised of casing halves 54 and 56 (see FIG. 3). It is preferred, however, that each of casing halves 54 and 56 be separately fabricated and that these halves be joined to each other by suitable means such as, e.g., adhesive means, clamps, bolts, and the like. When casing halves 54 and 56 are joined to each other, diaphragm 38 should be disposed between such casing halves and secured between the mating surfaces of such casing halves.

The diaphragm 38 may consist essentially of any material conventionally used in diaphragms for such fluid transducers. It is preferred that the diaphragm consist of a material which is resistant to physical and chemical degradation when exposed to either the hydraulic fluid or the process fluid. Some suitable materials which may be used for the diaphragm 38 include "TEFLON," "KALREZ" (a fluoroelastomeric rubber sold by E. I. du Pont de Nemours and Company), "VITON" (a fluoroelastomer based on the copolymer of vinylidene fluoride and hexafluoropropylene, which is sold by E. I. du Pont de Nemours and Company), and the like.

The diaphragm 38 may be from about 0.005 to about 0.05 inches. In one preferred embodiment, the diaphragm 38 is less than about 0.02 inches thick.

In one embodiment, not shown, the diaphragm 38 is a composite material comprised of a chemically and physically resistant material on its top surfaces and a material which need not be so resistant on its bottom surface; for only the top surface is contacted with the process fluid which can readily cause its chemical and/or physical degradation. By the same token, in another embodiment (not shown) casing half 54 is comprised of said chemically and/or physically resistant material, but casing half 56 need not comprise said material.

Each of casing halves 54 and 56 is comprised of an intake/output port, such as, e.g., port 40 (see FIG. 2); and each casing half contains, on its interior surface, a substantially bowl-shaped cavity.

The casing halves 54 and 56, when attached to each other, define a casing 52 which is comprised of intake/output ports 40 and 42 and which thus contain a pair of bowl-shaped cavities, the open sides of which face each other, and which are separated by the diaphragm 38; i.e., the bowl shape of the cavity of casing 56 is open upwards, and the bowl-shape of the cavity of casing 54 is open downwards, with these two cavities affixed immediately adjacent to each other and separated by diaphragm 38.

In one embodiment, not shown, casing half 54 is comprised of two separate pieces. In this embodiment, the top half of such casing is comprised of the casing material described above; and, as originally fabricated, it has substantially the same dimensions as the casing half 54. Thereafter, a portion of the bottom half of such casing is removed and replaced by a plate of suitably resistant material which is dimensioned identically to the material removed, so that the composite casing half 54 so produced has substantially the same dimensions as casing half 56. The plate so produced may then be attached to casing half 56 separately from the remaining portion of the upper casing by suitable means so that it will retain the diaphragm 38 intact and maintain sealed and undisturbed the hydraulic fluid contained in the hydraulic circuit shown below line H—H in FIG. 1, including lines 42A, 42B, and 42C, rotary timing valve 16, pump 12, flow meter 14, and other connecting lines. Such provisions are made to facilitate inspection of the diaphragm 38 and the upper casing half 54 in the event such inspection is necessary.

Referring again to FIG. 3, a preferred profile of curvature for services 90 of the bowl-shaped cavities of casings 54 and 56 is described. In enlargement 92, point represents the innermost position where the location of the diaphragm 38 is fixed by the clamping action of casings 54 and 56. Along further points inward on casings 54 and 56, a small radius of curvature 96 is fabricated, which effects the transition from the flat clamping surfaces at point 94 to the substantially bowl-shaped surfaces 90. From the radius of curvature 96, each surface 90 is comprised of a substantially circular arc.

In a preferred embodiment, for a bowl-shaped cavity of radius R, as measured from point 94 in enlargement 92 across its maximum diameter to a corresponding point (not shown) opposite point 94, the radius of curvature 96 was equal to 0.06 times R; the radius of the spherical arc comprising the remainder of surface 90 from its inner section with radius of curvature 96 at each end was 1.15 times R; and the resulting depth of the bowl-shaped cavity was approximately 0.55 times R. The benefit of this preferred geometry is when the diaphragm reaches close proximity to either upper or lower surface 90 during a fluid pumping operation (previously described), as the pumping proceeds further, the ring of contact of the diaphragm 38 around the bowl-shaped cavities of either casings 54 of 56 along surfaces 90 will begin at point 94, move sequentially along radius of curvature 96, and proceed inward to the center of the bowl where fluid is expelled from the outlet from the cavity (in FIG. 3, cavity 44 and bowl center point 98B). Such a progression results in minimal stresses on diaphragm 38 while simultaneously enabling complete and repeatable expulsion of process or hydraulic fluid from the transducer 18, which is beneficial when using transducer 18 in a batch delivery mode, an embodiment which will be described later.

In a further embodiment, not shown, small grooves approximately 0.12 inch wide by 0.06 inch deep, are cut into surfaces 90 of FIG. 3, running from centerpoint 98A and 98B of casings 54 and 56 radially outward along a length of 0.75 ×R; said grooves are spaced around the bowl-shaped surface 90 at 45 degree intervals. In addition, at centerpoints 98A and 98B where ports 40 and 42 are connected to cavities 44 and 48, respectively, a plurality of small holes, typically 0.06 inch diameter, are provided to achieve said connection through surface 90. These features also facilitate complete expulsion of fluid from transducer 18 and result in minimal stress on membrane 38 when it achieves total contact with either of surfaces 90. Said features are beneficial when using transducer 18 in a batch delivery mode.

Figure 7:
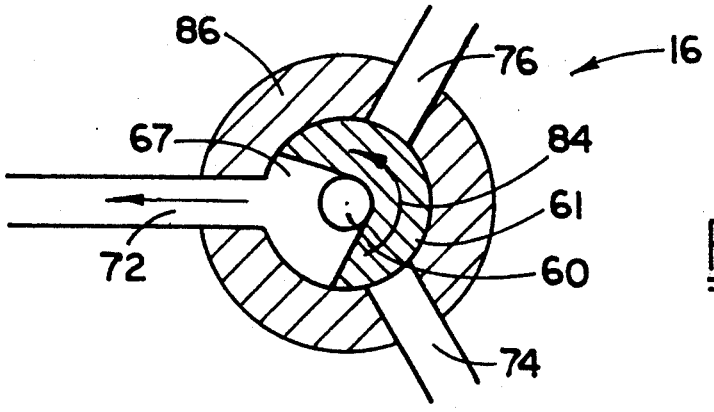
FIG. 7 is a sectional view, taken along lines 7—7 of FIG. 6, of the timing valve of FIG. 6.

The preferred rotary timing valve 16 used in the apparatus of FIG. 1 is illustrated in FIG. 7. This preferred rotary timing valve provides a unitary means for continuously and sequentially withdrawing hydraulic fluid from a first of said fluid transducers while simultaneously pumping the same hydraulic fluid to a second of said fluid transducers, and thereafter withdrawing hydraulic fluid from a second of said fluid transducers while simultaneously pumping the same hydraulic fluid to a third of said fluid transducers, and thereafter withdrawing hydraulic fluid from a third of said fluid transducers while simultaneously pumping the same hydraulic fluid to the first of said fluid transducers.

Unlike prior art devices, which often utilize several structures to pump hydraulic fluid to element while withdrawing hydraulic fluid from another element, applicant's means for performing the function is preferably unitary; only one structure is preferably needed to perform both of these functions. Thus, applicant s device is substantially simpler, less expensive, and more efficient than prior art devices.

Figure 6:
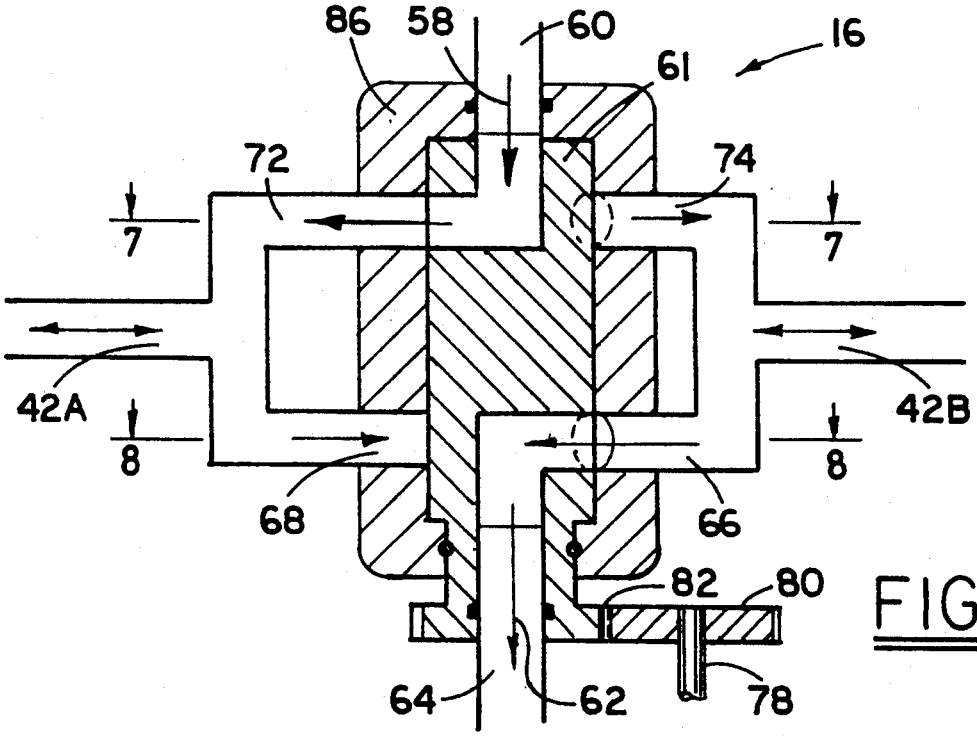
FIG. 6 is sectional view of a rotary timing valve used in the embodiment of FIG. 1.
Figure 8:
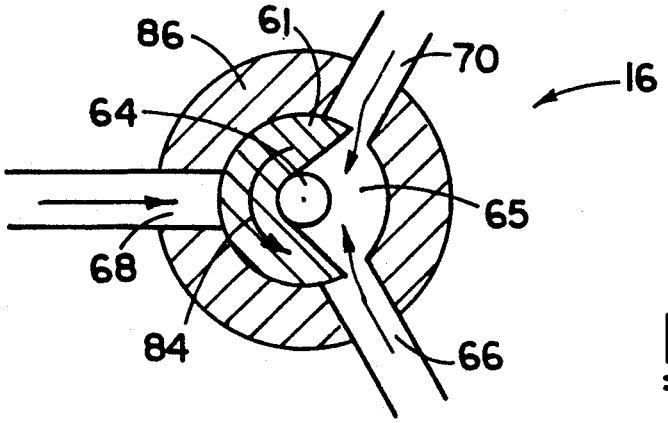
FIG. 8 is a sectional view, taken along lines 8—8, of the timing valve of FIG. 6.

In one embodiment, not shown, two separate valves which are synchronized are used to perform the function of the timing valve illustrated in FIGS. 6, 7, and 8.

One preferred embodiment of timing means 16 is illustrated in FIG. 6.

Referring to FIG. 6, it will be seen that hydraulic fluid enters means 16 through port 60; reference also may be had to FIG. 7, which is a sectional view of the embodiment of FIG. 6, in which it is indicated that fluid enters the top port 60 of said means.

Referring to FIG. 7, in the embodiment illustrated therein, fluid entering port 60 will exit through port 72 when rotatable plug 61 is in the position shown in FIG. 7.

Any means for rotating plug 61 within means 16 to continuously and selectively block at least one port of means 16 while opening another such port may be used. In the embodiment illustrated in FIG. 6, rotating shaft 78 which is connected to a suitable source of power (not shown) causes gear 80 to rotate plug 61; in the embodiment shown in FIG. 6, gear 80 is suitably operatively attached to plug 61 by connecting means 82.

FIG. 8 is a sectional view of the means 16, taken along lines 8—8. It will be apparent that the porting used in the bottom of means 16 is different than the porting used in the top of means 16; in the bottom of such means 16, plug 61 is offset by about 160 degrees. Referring to FIG. 8, it will be seen that port 68 is blocked and ports 66 and 70 are at least partially open. In the embodiment illustrated in this FIG. 8, fluid enters means 16 through ports 66 and 70 and is withdrawn from means 16 through port 64 in the direction of arrow 62.

In the preferred embodiments illustrated in FIGS. 6, 7, and 8, means 16 is comprised of a rotatable plug 61, means for causing rotation of said plug, and a casing 86 comprised of at least three ports.

The use of at least three ports for each of the hydraulic fluid withdrawal function and the hydraulic fluid pumping function in applicant's preferred means 16 enables a smooth transition between the withdrawing of fluid from one of such ports, to the withdrawing of said fluid from a second of said ports, to the withdrawing of said fluid from a third of said ports, and for the simultaneous transition between the pumping of fluid from one of such ports, to the pumping of fluid to a second of said ports, to the pumping of said fluid to a third of such ports. Thus, in applicant's preferred means 16, at least six ports must exist. Furthermore, inasmuch as means 16 must also contain master intake port 60 and master outlet port 64, means 16 should contain at least eight ports.

FIGS. 9A through 9B illustrate the fluid flow in means 16 at one position of plug 61. In this embodiment, hydraulic fluid flows into means 16 through port 60, and exits means 16 through port 72. Fluid also flows into means 16 through port 66 and exits through port 64.

FIGS. 10A and 10B Illustrate the fluid flow in means 16 at another sequential position of plug 61 on its timing cycle. In this embodiment, hydraulic fluid flows into means 16 through port 60, and exits means 16 through port 72. Fluid also simultaneously flows into means 16 through ports 66 and 70 and exits through port 64.

FIGS. 11A and 11B illustrate the fluid flow in means 16 at another sequential position of plug 61 in its timing cycle. In this embodiment, hydraulic fluid flows into means 16 through port 60, and exits means 16 through port 72. Fluid also flows into means 16 through port 70 and exits through port 64.

FIGS. 12A and 12B illustrate the fluid flow in means 16 at another position of plug 61. In this embodiment, hydraulic fluid flows into means 16 through port 60, and exits means 16 through ports 72 and 74. Fluid also flows into means 16 through port 70 and exits through port 64.

FIGS. 13A and 13B illustrate the fluid flow in means 16 at another position of plug 61. In this embodiment, hydraulic fluid flows into means 16 through port 60, and exits means 16 through port 74. Fluid also flows into means 16 through port 70 and exits through port 64.

FIGS. 14A and 14B illustrate the fluid flow in means 16 at another position of plug 61. In this embodiment, hydraulic fluid flows into means 16 through port 60, and exits means 16 through port 74. Fluid also flows into means 16 through ports 70 and 68 and exits through port 64.

Figures 15A, 15B, 16A, 16B, 17A, 17B, 18A, 18B, 19A, 19B, 20A, 20B:
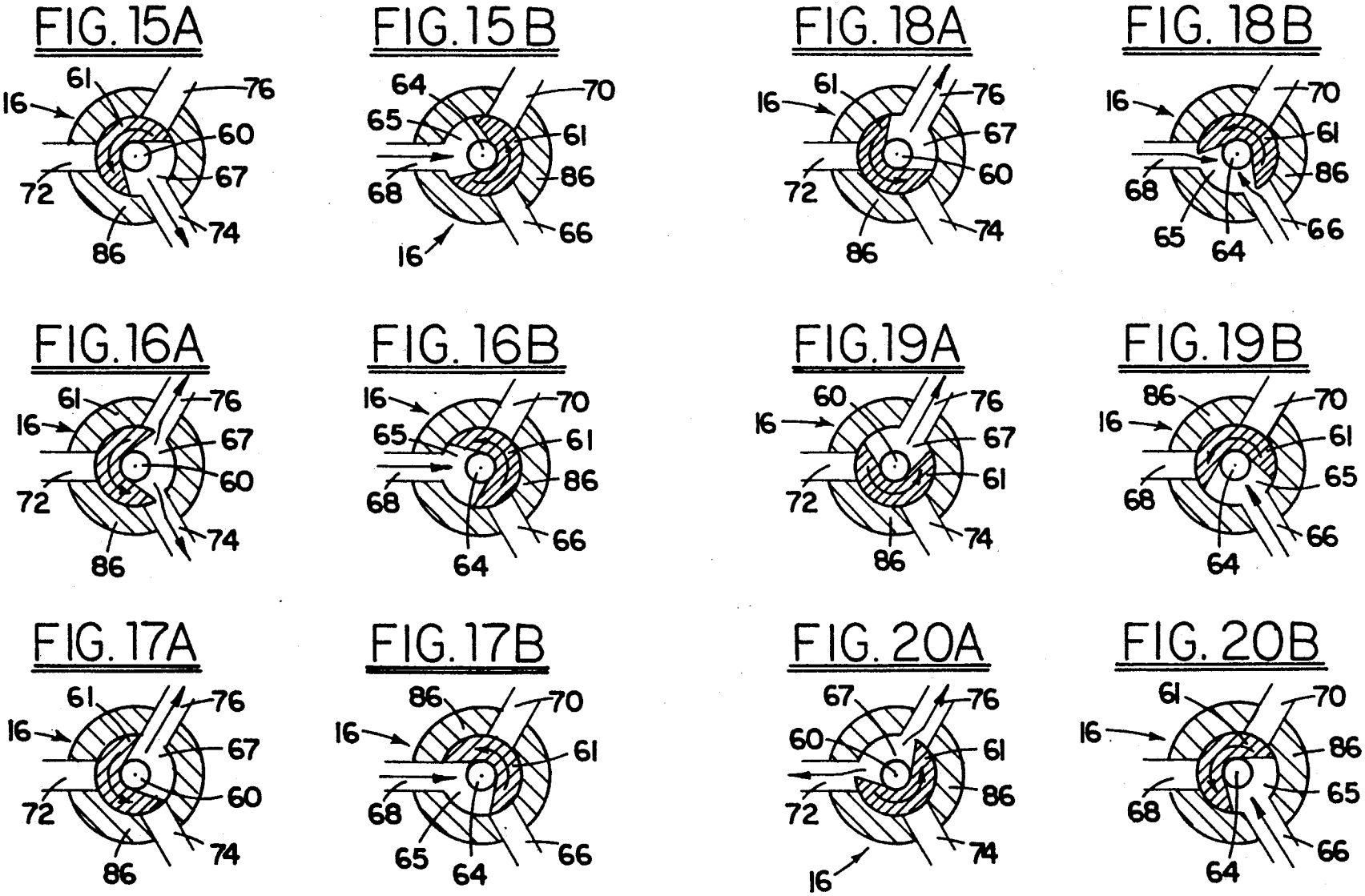

FIGS. 15A and 15B illustrate the fluid flow in means 16 at another position of plug 61. In this embodiment, hydraulic fluid flows into means 16 through port 60, and exits means 16 through port 74. Fluid also flows into means 16 through port 68 and exits through port 64.

FIGS. 16A and 16B illustrate the fluid flow in means 16 at another position of plug 61. In this embodiment, hydraulic fluid flows into means 16 through port 60, and exits means 16 through ports 74 and 76. Fluid also flows into means 16 through port 68 and exits through port 64.

FIGS. 17A and 17B illustrate the fluid flow in means 16 at another of plug 61. In this embodiment, hydraulic fluid flows into means 16 through port 60, and exits means 16 through port 76. Fluid also flows into means 16 through port 68 and exits through port 64.

FIGS. 18A and 18B illustrate the fluid flow in means 16 at another position of plug 61. In this embodiment, hydraulic fluid flows into means 16 through port 60, and exits means 16 through port 76. Fluid also flows into means 16 through ports 68 and 66 and exits through port 64.

FIGS. 19A and 19B illustrate the fluid flow in means 16 at another position of plug 61. In this embodiment, hydraulic fluid flows into means 16 through port 60, and exits means 16 through port 76. Fluid also flows into means 16 through port 66 and exits through port 64.

FIGS. 20A and 20B illustrate the fluid flow in means 16 at another position of plug 61. In this embodiment, hydraulic fluid flows into means 16 through port 60, and exits means 16 through ports 76 and 72. Fluid also flows into means 16 through port 66 and exits through port 64.

Because of the unique design of applicant's preferred embodiment of timing means 16, the transition between the time when fluid is pumped or withdrawn from one port, and pumped or withdrawn into a second port, is a smooth one, insuring a relatively constant flow rate. Thus, by way of illustration, and referring again to FIGS. 11A through 13A, it will be seen that, in FIG. 11A, fluid is being pumped into port 60 and out of port 72. Thereafter, as plug 61 rotates counterclockwise and thus causes a transition to the position of FIG. 12A, the plug 61 gradually opens the porting for port 74 while simultaneously gradually closing the porting for port 72. By such gradual, simultaneous transition, a smooth, continuous flow rate is assured; and substantial accelerations of the fluid downstream from port 74 and/or deceleration of the fluid in port 72 (as it is closed off) are avoided.

Thus, the apparatus of applicant's invention allows one to pump fluid without subjecting it to a substantial amount of shear. In applicant's preferred embodiment, at no point during the pumping cycle is the process fluid subjected to shear due to rapid movement of any mechanical components which are in close proximity to one another.

The apparatus of applicant's invention also allows one to provide a substantially constant flow rate of process fluid. As used in this specification, the term substantially constant flow rate refers to a flow rate which, preferably, does not vary more than 1.0 percent at any time during the pumping cycle.

This substantially constant flow rate of process fluid from metering pump 10, indicated by arrow 35 in FIG. 1, is accomplished through rotary timing valve 16 which enables rotary gear pump 12 to provide a correspondingly substantially constant flow rate of hydraulic fluid into one or two of transducers 18, 20, or 22, while simultaneously withdrawing a correspondingly substantially constant flow rate from one or two of transducers 18, 20, or 22, which is not receiving hydraulic fluid.

FIGS. 9A through 20A represent sequential but not discrete positions of a portion of rotary timing valve 16, also shown in a single position in FIG. 7, which accomplishes the function of receiving a substantially constant flow rate of fluid into port 60, and distributing it out one or two of ports 72, 74, or 76. By continuous 360 degree counterclockwise rotation of plug 61, the fluid flow out of these ports continuously cycles through the transition commencing with FIG. 9A, out port 72 only; out ports 72 and 74; out port 74 only; out ports 74 and 76; out port 76 only; out ports 76 and 72, in FIG. 20A; out port 72 only in FIG. 9A; and so forth, repeatedly through the cycle.

Likewise, FIGS. 9B through 20B represent sequential but not discrete positions of another portion of rotary timing valve 16, also shown in a single position in FIG. 8, which accomplishes the function of allowing the withdrawal of a substantially constant flow rate of fluid out of port 64, by enabling port 64 to be connected with one or two of inlet ports 66, 70, or 68. By continuous 360 degree counterclockwise rotation of plug 61, the fluid flow into these ports 66, 70, and 68 and out of port 64 continuously cycles through the transition commencing with FIG. 9B, into port 66 only; into ports 66 and 70; into port 70 only; into ports 70 and 68; into port 68 only; into ports 68 and 66, at FIG. 18B; and into port 66 only again at FIG. 20B; and so forth, repeatedly through the cycle.

It is critical to maintain the timing of valve porting for fluid distribution to and fluid withdrawal from the multiple ports, as it is shown in FIGS. 9A and 9B through 20A and 20B. In a preferred embodiment of applicant's rotary timing valve, shown in FIGS. 6 through 8, the port opening 65 enables fluid withdrawal from port 64 via flow into one or two of ports 66, 70 (not shown), or 68; and port 67 enables fluid delivery into port 60 and onward out of one or two of ports 72, 74, or 76 (not shown). Said port openings 65 and 67 are provided in a single rotating plug 61. The geometrical dimensions of port openings for delivery and withdrawal are identical, but the port opening 65 for withdrawal, shown sectionally in FIG. 8, is always displaced angularly 160 degrees from the port opening 67 for delivery shown sectionally in FIG. 7. Noting in FIG. 6 that delivery port 72 and withdrawal port 68 are combined into line 42A; and that delivery port 74 and withdrawal port are combined into line 42B; and that delivery port 76 (not shown) and withdrawal port 70 (not shown) are combined into line 42C; it is apparent that, due to the 160 degree angular displacement between withdrawal port opening 65 in FIG. 8 and delivery port opening 67 in FIG. 7, that at no time will rotary timing valve 16 in FIG. 6 allow the flow of fluid out port 72 and into port 68, thereby bypassing line 42A; nor will it allow the flow of fluid out of port 74 and into port 66, thereby bypassing line 42B; nor will it allow the flow of fluid out port 76 (not shown) and into port 70 (not shown), thereby bypassing line 42C. In this manner, when fluid is provided to port 60 of rotary timing valve 16, while it is simultaneously withdrawn from port 64 of rotary timing valve 16, fluid will always flow out of rotary timing valve 16 through one or two of lines 42A, 42B, or 42C, while it simultaneously flows into rotary timing valve 16 through one or two of lines 42A, 42B, or 42C, which are not in service for the inflow described immediately above.

Figure 21:
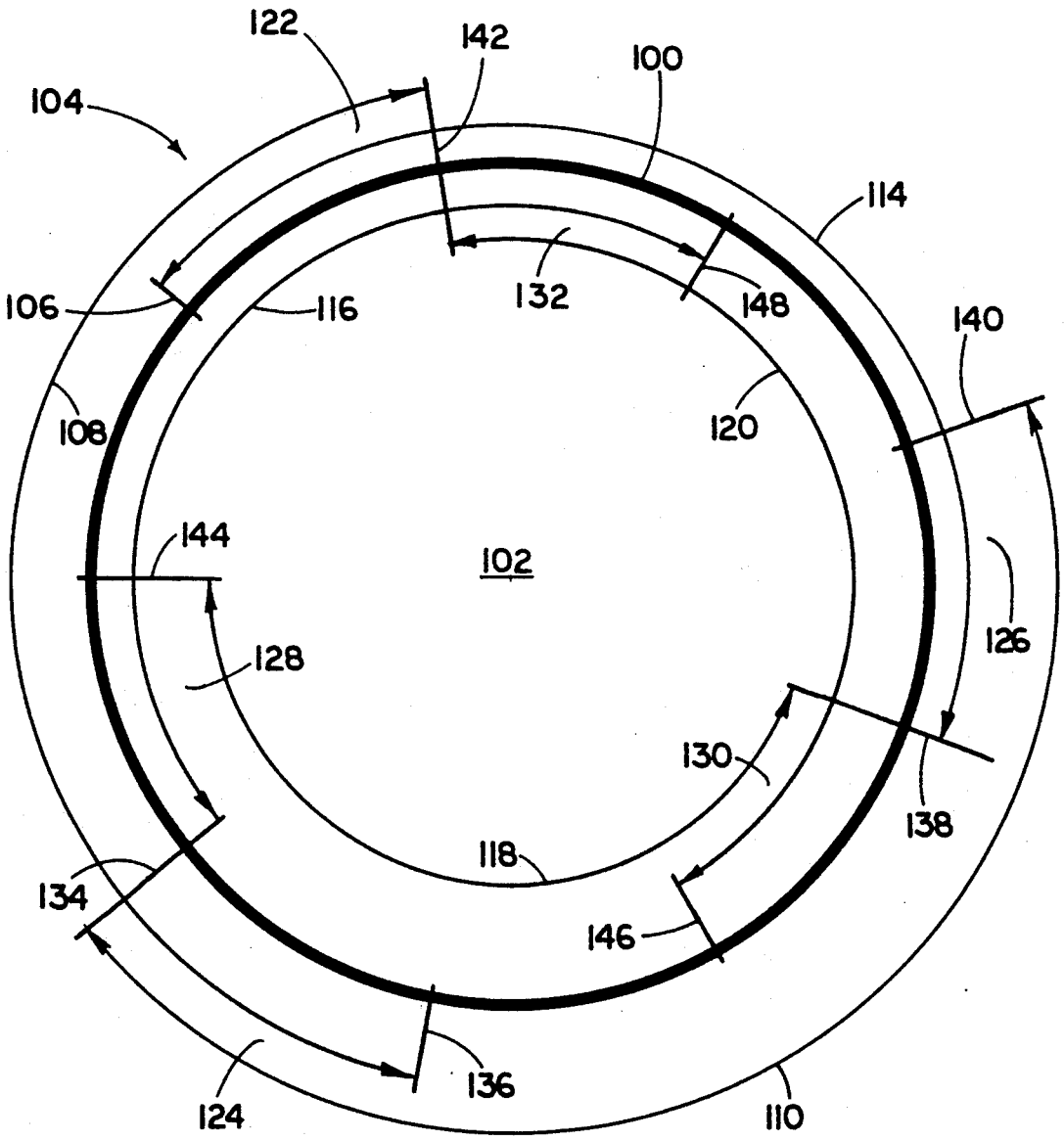
FIG. 21 is a representation of the timing of the rotary timing valve of FIG. 6, illustrating such timing through a complete 360 degree cycle of operation.

By way of further illustration, FIG. 21 represents a timing cycle for a preferred embodiment of rotary timing valve 16. Circle 100 represents a timing cycle through 360 degrees of operation, with point 106 on the circle representing the 0 degree starting point, also corresponding to the plug 61 rotational position shown in FIGS. 9A and 9B. The pathway around the inside 102 of circle 100 represents the timing of withdrawal of fluid into rotary timing valve 16 through lines 42A, 42B, or 42C, shown in FIG. 1. Likewise, the pathway around the outside 104 of the circle 100 represents the timing of delivery of fluid out of rotary timing valve 16 through lines 42A, 42B, or 42C shown in FIG. 1.

Arc 108 shows the timing of fluid flow out of the rotary timing valve 16 through line 42A in FIG. 1, commencing at point 142, and ending at point 136. Additionally, point 142 also corresponds with the plugs 61 rotational position which would occur in the transition from FIG. 19A to FIG. 20A; and point 136 corresponds with the plugs 61 rotational position shown in FIG. 13A.

Arc 110 shows the timing of fluid flow out of the rotary timing valve 16 through line 42B in FIG. 1, commencing at point 134, and ending at point 140. Additionally, point 134 also corresponds with the plugs 61 rotational position which would occur in the transition from FIG. 11A to FIG. 12A; and point 140 corresponds with the plugs 61 rotational position shown in FIG. 17A.

Arc 114 shows the timing of fluid flow out of the rotary timing valve 16 through line 42C in FIG. 1, commencing at point 138, and ending at point 106. Additionally, point 138 also corresponds with the plug 61 rotational position which would occur in the transition from FIG. 15A to FIG. 16A; and point 106 corresponds with the plug 61 rotational positron shown in FIG. 9A.

The timing of fluid flow into rotary timing valve 16 is described in like manner. Arc 116 shows the timing of fluid flow into the rotary timing valve 16 through line 42B, commencing at point 148 and ending at point 134. Additionally, point 148 also corresponds with the plugs 61 rotational position which occurs in FIG. 17B, and point 134 corresponds with the plugs 61 rotational position which would occur in the transition from FIG. 10B to FIG. 11B.

Arc 118, shows the timing of fluid flow into the rotary timing valve 16 through line 42C, commencing at point 144 and ending at point 138. Additionally, point 144 also corresponds with the plug 61 rotational positron which occurs in FIG. 9B, and point 138 corresponds with the plug 61 rotational position which would occur in the transition from FIG. 14B to FIG. 15B.

Arc 120 shows the timing of fluid flow into the rotary timing valve 16 through line 42A, commencing at point 146 and ending at point 142. Additionally, point 146 also corresponds with the plug 61 rotational position which occurs in FIG. 13B, and point 142 corresponds with the plug 61 rotational position which would occur in the transition from FIG. 18B to FIG. 19B.

It is apparent from the timing cycle 100 in FIG. 21 that delivery of fluid out through line 42A from rotary timing valve 16 immediately follows, but does not overlap with, flow of fluid in through line 42A into rotary timing valve 16. Likewise, delivery of fluid out through line 42B from rotary timing valve 16 immediately follows, but does not overlap with, flow of fluid in through line 42B into rotary timing valve 16. Likewise, delivery of fluid out through line 42C from rotary timing valve 16 immediately follows, but does not overlap with, flow of fluid in through line 42C into rotary timing valve 16.

It is also apparent that at any point along timing cycle 100 in FIG. 21, fluid flow is occurring out from rotary timing valve 16 through one or two of lines 42A, 42B, or 42C; while simultaneously fluid flow is occurring in through one or two of lines 42A, 42B, or 42C into rotary timing valve 16, which are not in service for outflow at that point.

Furthermore, it is apparent that a zone 122 of overlap in delivery out through lines 42C and 42A occurs between point 142 and point 106; and a zone 124 of overlap in delivery out through lines 42A and 42B occurs between point 134 and point 136; and a zone 126 of overlap in delivery out through lines 42B and 42C occurs between point 138 and point 140. Likewise, a zone 128 of overlap in flow in through lines 42B and 42C occurs between point 144 and point 134; and a zone 130 of overlap in flow in through lines 42C and 42A occurs between point 146 and point 138; and a zone 132 of overlap in flow in through lines 42A and 42B occurs between point 148 and point 142.

In order to attain the timing cycle 100 shown in FIG. 21, proper geometry of the porting in casing 86 and port openings in plug 61 relative to each other must exist. In the embodiment in FIGS. 7 and 8, the centerlines of ports 66, 70, and 68; and 72, 74, and 76, are spaced at 120 degree intervals. Furthermore, the port openings 67 in FIG. 7, and 65 in FIG. 8, have an opening of 120 degrees around the circumference of plug 61. Additionally, ports 72, 74, and 76 in FIG. 7, and ports 66, 70, and 68, in FIG. 8, have openings of 40 degrees around the inner surface of casing 86.

It will be apparent to one skilled in the art of rotary timing valve design that additional combinations of port and port opening locations may be used in order to achieve the same result, and that minor changes in the dimensions and location of the ports and port openings may improve reliability and manufacturability of rotary timing valve 16.

It will be further apparent to one skilled in the art of rotary timing valve design that combinations of wide angle ports in casing 86 and narrow angle port openings in plug 61, in FIGS. 7 and 8, may be used to achieve substantially the same results as presented in FIG. 21.

It also will be apparent to those skilled in the art that, although the operation of plug 61 has been described with counterclockwise rotation, substantially the same results are obtained with clockwise rotation of such plug.

Referring again to FIG. 1, the operation of applicant'-preferred metering pump 10 will now be described. At the start of operation, the system is primed; if it is not already full of hydraulic fluid, it may be so filled by conventional means.

Gear pump 12 continuously circulates fluid through flow meter 14 and on into rotary timing valve 16; and it simultaneously withdraws fluid from timing valve 16.

Gear pump 12 provides a means of producing a substantially constant flow rate of hydraulic fluid in the hydraulic circuit comprised of gear pump 12, line 11, flow meter 14, line 13, pressure relief valve 15, line 17, rotary timing valve 16, and line 19. It will be appreciated that, in general, no flow of hydraulic fluid in line 21 will occur unless pressure relief valve 15 discharges fluid due to excess pressure.

Any rotary pump which is capable of providing a substantially constant flow rate (as defined in this specification) may be used as pump 12. Thus, by way of illustration, one may use a gear pump, a vane pump, and the like. One preferred pump is a Zenith precision metering pump of the model B Series (sold by the Zenith Pumps Division of Parker Hannifin Corporation, Sanford, N.C.) together with a ZeDrive precision pump speed control system (also sold by said Zenith Pumps Division). These components are described in Bulletin Z-86 (1990).

The metering pump assembly 10 is also comprised of means for synchronizing the rotation of rotary pump 12 with the rotation of plug 61 of timing valve 16; as is illustrated in FIG. 1, these components are operatively connected (by line 23 to such synchronizing means 25.

Any means for synchronizing the output of two rotary fluid assemblies may be used as means 25. In one preferred embodiment, means 25 is a mechanical coupling such as, e.g., a timing belt, pulleys, and speed reducer. In another embodiment, means 25 is comprised of a pair of asynchronous stepper motors.

Again referring to FIG. 1, the hydraulic fluid pumped into rotary timing valve 16 is distributed to and withdrawn from fluid transducers 18, 20, and 22 as described elsewhere in this specification.

The hydraulic fluid withdrawn from fluid transducers 18, 20, and 22 causes a corresponding withdrawal of the process fluid from reservoir 36 through valving means 24, 26, 28, 30, 32, and 34 into transducers 18, 20, and 22 (through lines 41A, 41B, and 41C). Likewise, the hydraulic fluid pumped to fluid transducers 18, 20, and 22 causes a corresponding flow of the process fluid from transducers 18, 20, and 22 through 43A, 43B, and 43C, combining into line 45 and moving onward through said line to its desired destination.

Although check valves have been illustrated in FIG. 1 for valving means 24, 26, 28, 30, 32, and 34, it will be appreciated by those skilled in the art that other suitable valve means may also be used. Thus, for example, one also may use single three-way valve means coupled with control means, or pairs of two-way valve means coupled with control means, and the like.

Thus, it will be appreciated by those skilled in the art that, because of applicant's unique combination of rotary timing valve 16, liquid transducers 18, 20, and 22, and rotary pump 12, the substantially constant liquid output of pump 12 results in a correspondingly substantially constant output of the process fluid through line 45 and, concurrently, a substantially constant and equal withdrawal of the process fluid from reservoir 36, without requiring such process fluid to contact the workings of the rotary pump 12 and/or to be subjected to substantial acceleration or shear.

Figure 22:
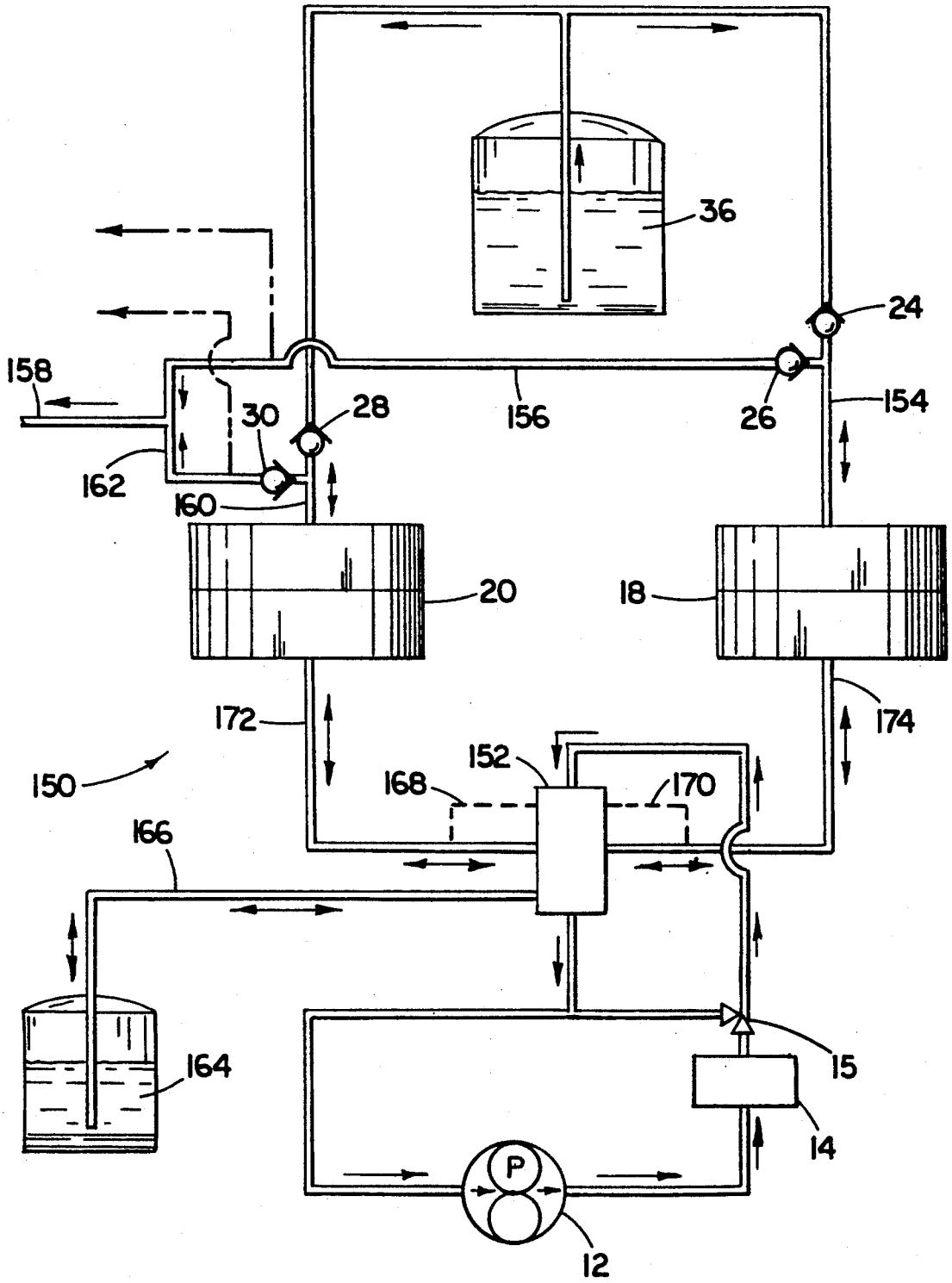
FIG. 22 is a schematic of another embodiment of applicant's invention which is adapted to operate in a batch mode.

FIG. 22 illustrates one preferred embodiment of applicant's invention which may be used to deliver, in an alternating manner, batches of fluid from one pair of fluid transducers.

Referring to FIG. 22, it will be seen that pumping assembly 150 is comprised of rotary pump 12, flow meter 14, pressure relief valve 15, valving means 152, fluid transducers 18 and 20, reservoir 36, and valving means 24, 26, 28, and 30.

Valving mans 152 provides a means for alternately pumping hydraulic fluid to transducer 18 while simultaneously withdrawing hydraulic fluid from transducer 20, thereby during this portion of the cycle causing process fluid from transducer 18 to be pumped via lines 154 and 156 out of line 158. Once all of the process fluid has been pumped out of transducer 18, the valving means 152 switches its mode of operation and enables the withdrawal of hydraulic fluid from transducer 18 while causing the pumping of hydraulic fluid to transducer 20. During this portion of the cycle, process fluid is caused to flow from transducer 20 through lines 160 and 162 to output line 158.

Any fluid valving means which is able to alternately switch fluid from one fluid transducer to another may be used as valving means 152. Thus, by way of illustration and not limitation, one may use a rotary timing valve, a manifold of spool valves, and the like. By way of further illustration, one may use a VERSA valve, K Series (Versa Products Company Inc., Paramus, N.J., see catalog number GC384, published in 1982).

Referring again to FIG. 22, hydraulic fluid reservoir 164 may be used to prime the system upon startup, through line 166.

In one embodiment, illustrated in FIG. 22, pump assembly 150 is comprised of means 168 and 170 for connecting lines 172 and 174 to switching means for valve means 152. When pressure or vacuum is sensed in lines 172 or 174, switching of valve means 152 can be automatically triggered.

Figure 23:
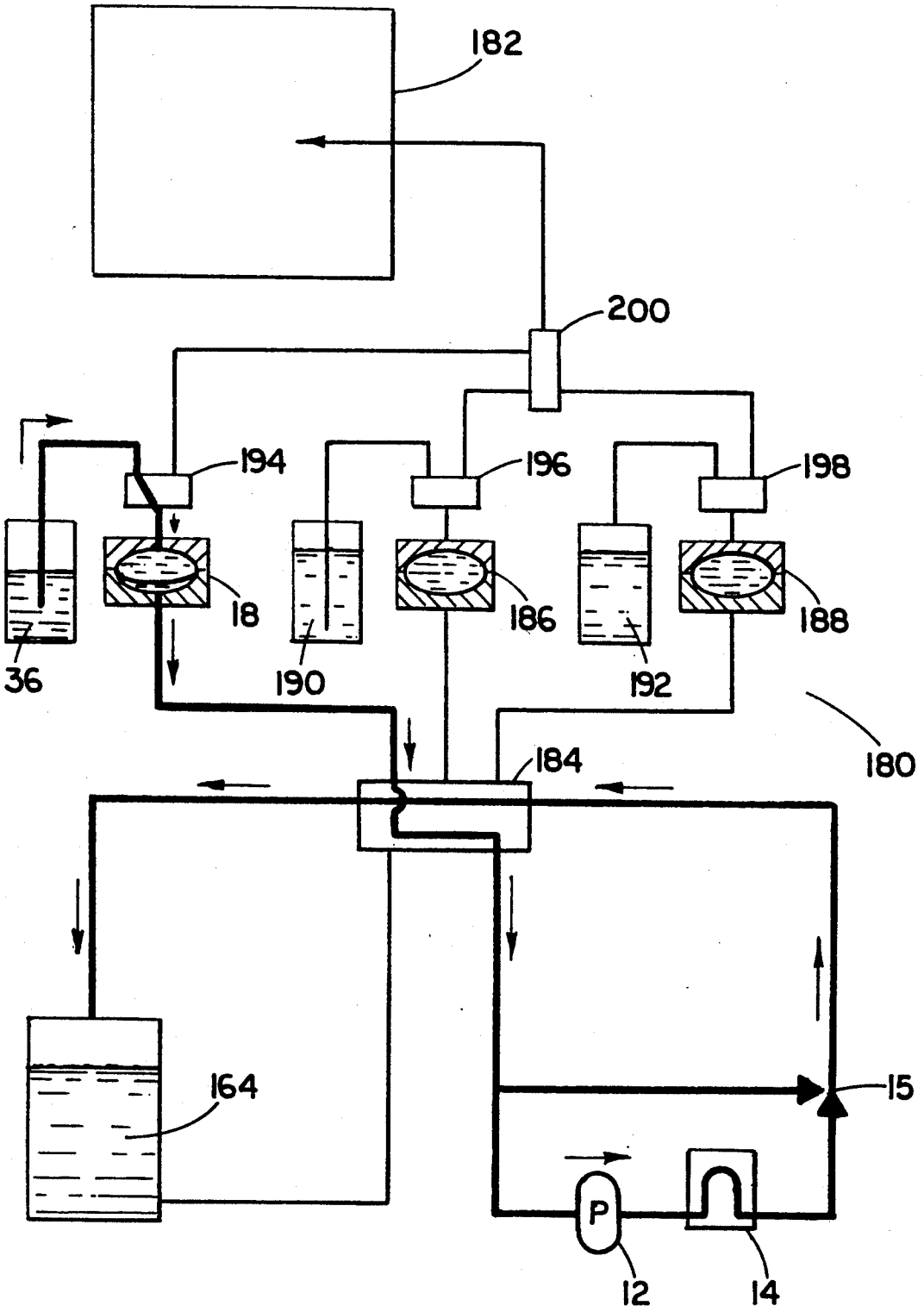
FIG. 23, 24, and 25 each illustrate a separate mode of operation for an apparatus which is also adapted to operate in a batch mode.
Figure 24:
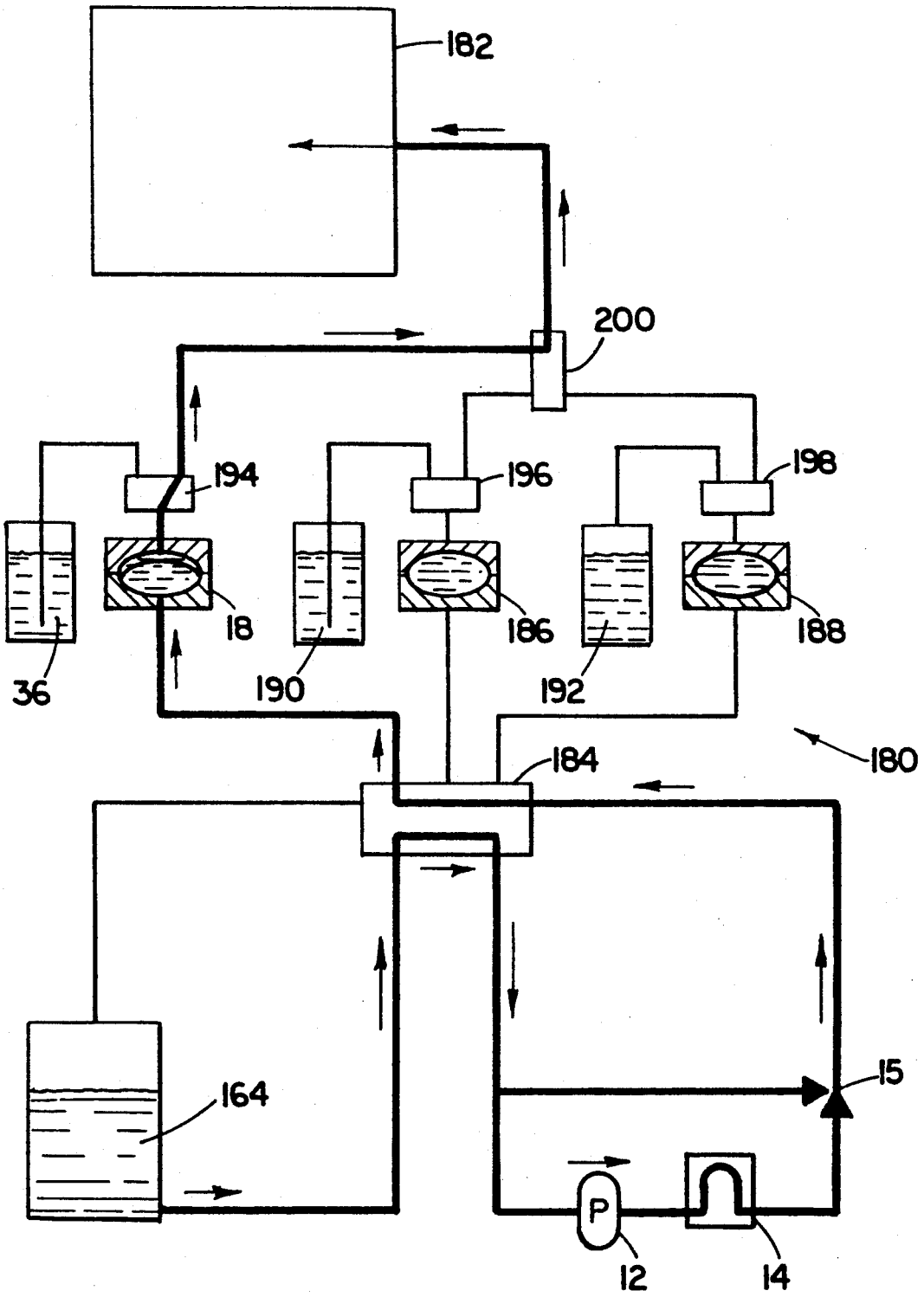
Figure 25:
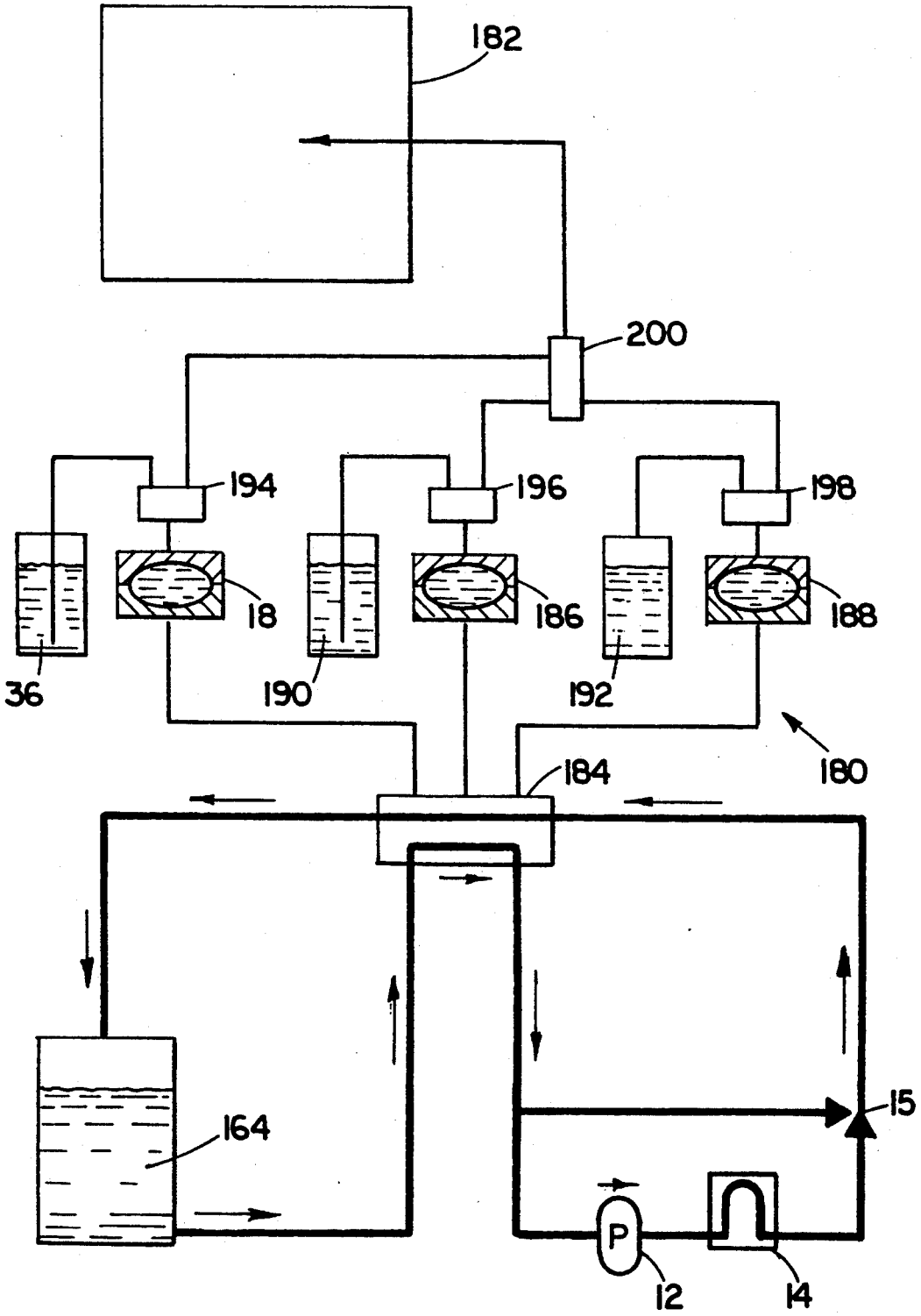

FIGS. 23, 24, and 25 each illustrate another preferred embodiment of applicant's invention in which pump assembly 180 provides a means for the simple batch delivery of a process fluid to a desired apparatus 182. This pump assembly 180 is comprised of rotary pump 12, flow meter 14, relief valve 15, valving means 184, hydraulic fluid reservoir 164, fluid transducers 18, 186, and 188, process fluid reservoirs 36, 190, and 192, and valving means 194, 196, 198, and 200.

FIG. 23 illustrates the pump assembly 180 in a mode in which transducer 18 is being filled with process fluid. FIG. 24 illustrates the pump assembly 180 in a mode in which transducer 18 is delivering process fluid to apparatus 182 via switching of valve means 184. FIG. 25 illustrates a mode in which pump assembly 180 is in standby, in which hydraulic fluid recirculates from reservoir 164 through valve means 184, through rotary pump 12, through flow meter 14, through valve means 184, and back to hydraulic fluid reservoir 164.

As will be apparent to those skilled in the art, valve means 184 and valve means 200 allow the selection and delivery of a plurality of process fluids shown contained in reservoirs 36, 190, and 192. These valve means are well known to those skilled in the art. Thus, for example, one may use the same valves as was discussed for the embodiment of FIG. 21.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An apparatus for pumping fluid at a substantially constant flow rate, wherein said apparatus is comprised of:

(a) a first fluid transducer means for hydraulically coupling a hydraulic fluid to another fluid while preventing said hydraulic fluid from contacting said other fluid;

(b) a second fluid transducer means for hydraulically coupling a hydraulic fluid to another fluid while preventing said hydraulic fluid from contacting said other fluid;

(c) a third fluid transducer means for hydraulically coupling a hydraulic fluid to another fluid while preventing said hydraulic fluid from contacting said other fluid;

(d) means for delivering said hydraulic fluid to said first fluid transducer means, said second fluid transducer means, and said third fluid transducer means so that the sum of the flow rates of said hydraulic fluid delivered to said first transducer means, said second transducer means, and said third transducer means is substantially constant;

(e) timing means for continuously and sequentially repeating a timing cycle, wherein said timing cycle is comprised of the steps of:

1. withdrawing said hydraulic fluid from said first fluid transducer means while simultaneously delivering said hydraulic fluid to said second fluid transducer means while none of said hydraulic fluid is delivered to said third fluid transducer means;

2. thereafter, withdrawing said hydraulic fluid from said first fluid transducer means while simultaneously delivering said hydraulic fluid to said second fluid transducer means and simultaneously commencing delivery of said hydraulic fluid to said third fluid transducer means, wherein:

(a) said hydraulic fluid is initially delivered to said third transducer means at a substantially zero flow rate which thereafter increases;

(b) when said hydraulic fluid has been initially delivered to said third fluid transducer means, the flow rate of fluid delivered to said second fluid transducer means decreases; and (c) the total flow rate of fluid delivered to both said second fluid transducer means and said third fluid transducer means is substantially constant;

3. thereafter, withdrawing said hydraulic fluid from said first fluid transducer means while simultaneously commencing withdrawal of said hydraulic fluid from said second fluid transducer and simultaneously delivering said hydraulic fluid only to said third fluid transducer, wherein:

(a) said hydraulic fluid is initially withdrawn from said second fluid transducer means at a substantially zero flow rate which thereafter increases; and (b) when said hydraulic fluid has been initially withdrawn from said second fluid transducer means, the flow rate of hydraulic fluid withdrawn from said first fluid transducer means decreases;

4. discontinuing the withdrawal of said hydraulic fluid from said first fluid transducer means and thereafter withdrawing said hydraulic fluid only from said second fluid transducer means while simultaneously delivering said hydraulic fluid only to said third transducer means;

5. withdrawing said hydraulic fluid from said second fluid transducer means while simultaneously delivering said hydraulic fluid to said third fluid transducer means while none of said hydraulic fluid is delivered to said first fluid transducer means;

6. thereafter, withdrawing said hydraulic fluid from said second fluid transducer means while simultaneously delivering said hydraulic fluid to said third fluid transducer means and simultaneously commencing delivery of said hydraulic fluid to said first fluid transducer means, wherein:

(a) said hydraulic fluid is initially delivered to said first transducer means at a substantially zero flow rate which thereafter increases;

(b) when said hydraulic fluid has been initially delivered to said first fluid transducer means, the flow rate of fluid delivered to said third fluid transducer means decreases; and (c) the total flow rate of fluid delivered to both said first fluid transducer means and said third fluid transducer means is substantially constant;

7. thereafter, withdrawing said hydraulic fluid from said second fluid transducer while simultaneously commencing withdrawal of said hydraulic fluid from said third fluid transducer and simultaneously delivering said hydraulic fluid, only to said first fluid transducer, wherein:

(a) said hydraulic fluid is initially withdrawn from said third transducer means at a substantially zero flow rate which thereafter increases; and (b) when said hydraulic fluid has been initially withdrawn from said third fluid transducer means, the flow rate of hydraulic fluid withdrawn from said second fluid transducer means decreases;

8. discontinuing the withdrawal of said hydraulic fluid from said second fluid transducer means and thereafter withdrawing said hydraulic fluid only from said third fluid transducer means while simultaneously delivering said hydraulic fluid only to said first transducer means;

9. withdrawing said hydraulic fluid from said third fluid transducer means while simultaneously delivering said hydraulic fluid to said first fluid transducer means while none of said hydraulic fluid is delivered to said second fluid transducer means;

10. thereafter, withdrawing said hydraulic fluid from said third fluid transducer means while simultaneously delivering said hydraulic fluid to said first fluid transducer means and simultaneously commencing delivery of said hydraulic fluid to said second fluid transducer means, wherein:
   (a) said hydraulic fluid is initially delivered to said second transducer means at a substantially zero flow rate which thereafter increases;
   (b) when said hydraulic fluid has been initially delivered to said second fluid transducer means, the flow rate of fluid delivered to said first fluid transducer means decreases; and
   (c) the total flow rate of fluid delivered to both said first fluid transducer means and said second fluid transducer means is substantially constant;

11. thereafter, withdrawing said hydraulic fluid from said third fluid transducer while simultaneously commencing withdrawal of said hydraulic fluid from said first fluid transducer and simultaneously delivering said hydraulic fluid only to said second fluid transducer, wherein:
   (a) said hydraulic fluid is initially withdrawn from said first fluid transducer means at a substantially zero flow rate which thereafter increases; and
   (b) when said hydraulic fluid has been initially withdrawn from said first fluid transducer means, the flow rate of hydraulic fluid withdrawn from said third fluid transducer means decreases;

12. discontinuing the withdrawal of said hydraulic fluid from said third fluid transducer means and thereafter withdrawing said hydraulic fluid only from said first fluid transducer means while simultaneously delivering said hydraulic fluid only to said second transducer means;

(f) means for synchronizing said timing means with said means for providing a substantially constant flow of hydraulic fluid;

(g) means for allowing flow of said other fluid into said first fluid transducer, said second fluid transducer, and said third fluid transducer through a first conduit means; and (h) means for allowing flow of said other fluid out of said first fluid transducer, said second fluid transducer, and said third fluid transducer through a second conduit.

2. The apparatus as recited in claim 1, wherein said means for providing a substantially constant flow of hydraulic fluid is pump means.

3. The apparatus as recited in claim 2, wherein said pump means is comprised of a rotary pump.

4. The apparatus as recited in claim 1, wherein said apparatus is comprised of timing means for withdrawing hydraulic fluid from said third fluid transducer while simultaneously pumping said fluid to said first fluid transducer means.

5. The apparatus as recited in claim 1, wherein said timing means is a rotary timing means.

6. The apparatus as recited in claim 5, wherein said rotary timing means is unitary.

7. The apparatus as recited in claim 5, wherein said means for providing a substantially constant flow of hydraulic fluid is pump means.

8. The apparatus as recited in claim 7, wherein said pump means is hydraulic pump means.

9. The apparatus as recited in claim 8, wherein said rotary timing means provides said first fluid to each of said first fluid transducer means, said second fluid transducer means, and said third fluid transducer means.

10. The apparatus as recited in claim 9, wherein said first fluid transducer means, said second fluid transducer means, and said third fluid transducer means pump said second fluid at a substantially constant flow rate which is substantially equal to the flow rate of said first fluid provided by said rotary pump.

* * * * *